US007434808B2

(12) United States Patent
Sorge

(10) Patent No.: US 7,434,808 B2
(45) Date of Patent: Oct. 14, 2008

(54) METHOD OF PLAY AND GAME SURFACE FOR A DICE GAME

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 190 days.

(21) Appl. No.: 11/213,212

(22) Filed: Aug. 26, 2005

(65) Prior Publication Data

US 2005/0280208 A1 Dec. 22, 2005

Related U.S. Application Data

(63) Continuation-in-part of application No. 10/391,257, filed on Mar. 18, 2003, now Pat. No. 6,974,132.

(51) Int. Cl.
*A63F 9/04* (2006.01)

(52) U.S. Cl. ..... 273/274; 273/146

(58) Field of Classification Search ..... 273/274, 273/146, 145 R, 145 A, 145 C, 145 CA, 145 D, 273/145 E See application file for complete search history.

(56) References Cited

U.S. PATENT DOCUMENTS

| | | | | |
|---|---|---|---|---|
| 2,871,581 | A | 2/1959 | Guzak | |
| 3,208,754 | A | 9/1965 | Sieve | |
| 3,904,208 | A | 9/1975 | Grossman | |
| 4,312,508 | A | 1/1982 | Wood | |
| 4,334,685 | A | 6/1982 | Robbins et al. | |
| 4,346,900 | A | 8/1982 | Lamlee | |
| 4,635,938 | A | 1/1987 | Gray | |
| 4,717,154 | A | 1/1988 | Miller | |
| 4,746,126 | A | 5/1988 | Angileri | |
| 4,900,034 | A | 2/1990 | Bereuter | |
| 4,902,019 | A | 2/1990 | Berman | |
| 5,224,708 | A | 7/1993 | Gathman et al. | |
| 5,308,081 | A | 5/1994 | Bartle | |
| 5,350,175 | A | 9/1994 | DiLullo et al. | |
| 5,413,351 | A | 5/1995 | Franklin | |
| 5,490,670 | A | 2/1996 | Hobert | |
| 5,513,851 | A | 5/1996 | Harris | |
| 5,673,916 | A | 10/1997 | Horan | |
| 5,785,596 | A | 7/1998 | Hobert | |
| 5,829,748 | A | 11/1998 | Moore, Jr. | |
| 5,879,006 | A * | 3/1999 | Bowling | 273/274 |
| 5,909,874 | A | 6/1999 | Daniel et al. | |
| 5,961,117 | A | 10/1999 | Scarselli | |
| 6,116,603 | A | 9/2000 | Huang | |
| 6,176,489 | B1 | 1/2001 | Astaneha | |
| 6,179,293 | B1 | 1/2001 | Hedman | |
| 6,234,482 | B1 | 5/2001 | Henderson | |
| 6,974,132 | B2 | 12/2005 | Sorge | |

* cited by examiner

*Primary Examiner*—Benjamin H Layno
(74) *Attorney, Agent, or Firm*—Scully, Scott, Murphy & Presser, P.C.

(57) ABSTRACT

A method of playing a dice game using a pair of dice and a playing surface having a plurality of wagering areas. The game surface has sum wagering areas arranged in rows and columns, each of which correspond to possible numeric outcomes of a roll of the dice, and each of which has an associated color and payout ratio. The game surface also has range wagering areas, color wagering areas, column wagering areas, row wagering areas, doubles wagering areas, and doubles range wagering areas, each having an associated payout ratio. An all doubles wagering area, all sums wagering area and all sums all doubles wagering area are also provided.

5 Claims, 5 Drawing Sheets

METHOD OF PLAY AND GAME SURFACE FOR A DICE GAME

CROSS REFERENCE TO RELATED APPLICATIONS

This application is a Continuation-in-Part of U.S. patent application Ser. No. 10/391,257 filed on Mar. 18, 2003 now U.S. Pat. No. 6,974,132, which is hereby incorporated herein by reference.

BACKGROUND OF THE INVENTION

The invention relates to a method and game surface for playing a multi-sided dice game. More particularly, the invention relates to a dice game where the numbers are assigned colors and wherein the dice game has a game surface for wagering on different combinations of numbers and colors.

U.S. Pat. No. 5,909,874 to Daniel et al. discloses icosahedron decimal dice. U.S. Pat. No. 3,904,208 to Grossman discloses a pseudo four dimensional dice and game where each die has 12 rhombic shaped faces. U.S. Pat. No. 4,900,034 to Bereuter discloses random gambling playing pieces and a game table.

SUMMARY OF THE INVENTION

The present invention includes a method of playing a dice game using a pair of dice and a game surface. A primary player is first established and at least one wager is made by each player on the game surface. The players wager that one of a plurality of events will occur with the roll of the dice. The primary player then rolls the pair of dice and the wagers are resolved. Losing wagers are collected, while winning wagers are paid according to the payout of the designated area of the game surface.

If a player wagered on an area of the game surface designated for two specific identical numbers, or "doubles", and those two specific identical numbers are rolled, that player is paid the appropriate payout. If this winner also wagered on an area designated for a progressive bet associated with the winning doubles wager, that winner then rolls a single die. The winner is paid the progressive pot if the single die results in a designated number.

The invention also includes a method of playing a dice game using a pair of multi-sided dice and a playing surface having a plurality of wagering areas. A game surface comprising a plurality of sum wagering areas arranged in a plurality of rows and columns is provided. Each of the plurality of sum wagering areas corresponds to a possible numeric outcome of a roll of the pair of dice. Each of the plurality of sum wagering areas has a color associated with it, for example gold, black or red, and an associated payout ratio.

The game surface further comprises a plurality of range wagering areas. Each of the plurality of range wagering areas corresponds to a range of numeric outcomes of the roll of the pair of dice. Each of the plurality of range wagering areas also has a payout ratio associated with it.

The game surface also includes a plurality of color wagering areas. Each of the plurality of color wagering areas corresponds to one of the colors associated with at a sum wagering area. Each of the color wagering areas also has a payout ratio associated with it.

The game surface also has a plurality of column wagering areas. Each of the plurality of column wagering areas corresponds to at least one of the columns of sum wagering areas. Each of the plurality of column wagering areas has a payout ratio associated with it.

The game surface also has a plurality of row wagering areas. Each of the plurality of row wagering areas corresponds to at least one of the plurality of rows of sum wagering areas. Each of the plurality of row wagering areas also has a payout ratio associated with it.

A plurality of doubles wagering areas are also provided on the game surface. Each of the plurality of doubles wagering areas corresponds to a possible numeric outcome of the roll of the pair of dice comprising two identical numerals. Each of the plurality of doubles wagering areas also has an associated color and an associated payout ratio.

The game surface also has a plurality of doubles range wagering areas. Each of the doubles range wagering areas corresponds to a range of possible numeric outcomes of the roll of the pair of dice comprising two identical numerals. Each of the plurality of doubles range wagering areas also has a payout ratio associated with it.

The game surface has an all doubles wagering area which corresponds to all possible numeric outcomes of the roll of the pair of dice corresponding to two identical numerals. The all doubles wagering area has a payout ratio associated with it.

The game surface further includes an all sums wagering area corresponding to all of the plurality of sum wagering areas and an all sums all doubles wagering area corresponding to all of the plurality of sum wagering areas and all of the plurality of double wagering areas.

A player may indicate a wager by placing at least one wagering device within at least one of the wagering areas provided on the game surface, for example, a sum wagering area, a range wagering area, a color wagering area, a column wagering area, a row wagering area, a doubles wagering area, a doubles range wagering area, an all doubles wagering area, an all sums wagering area and/or an all sums all doubles wagering area.

A pair of multi-sided dice are rolled or thrown and the numeric outcome of the roll or throw is determined by totaling the results of each of the die.

Losing wagers are collected and wining wagers are paid according to the payout ratio associated with the wagering area corresponding to the winning wager.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

DETAILED DESCRIPTION OF THE INVENTION

Figure 1:
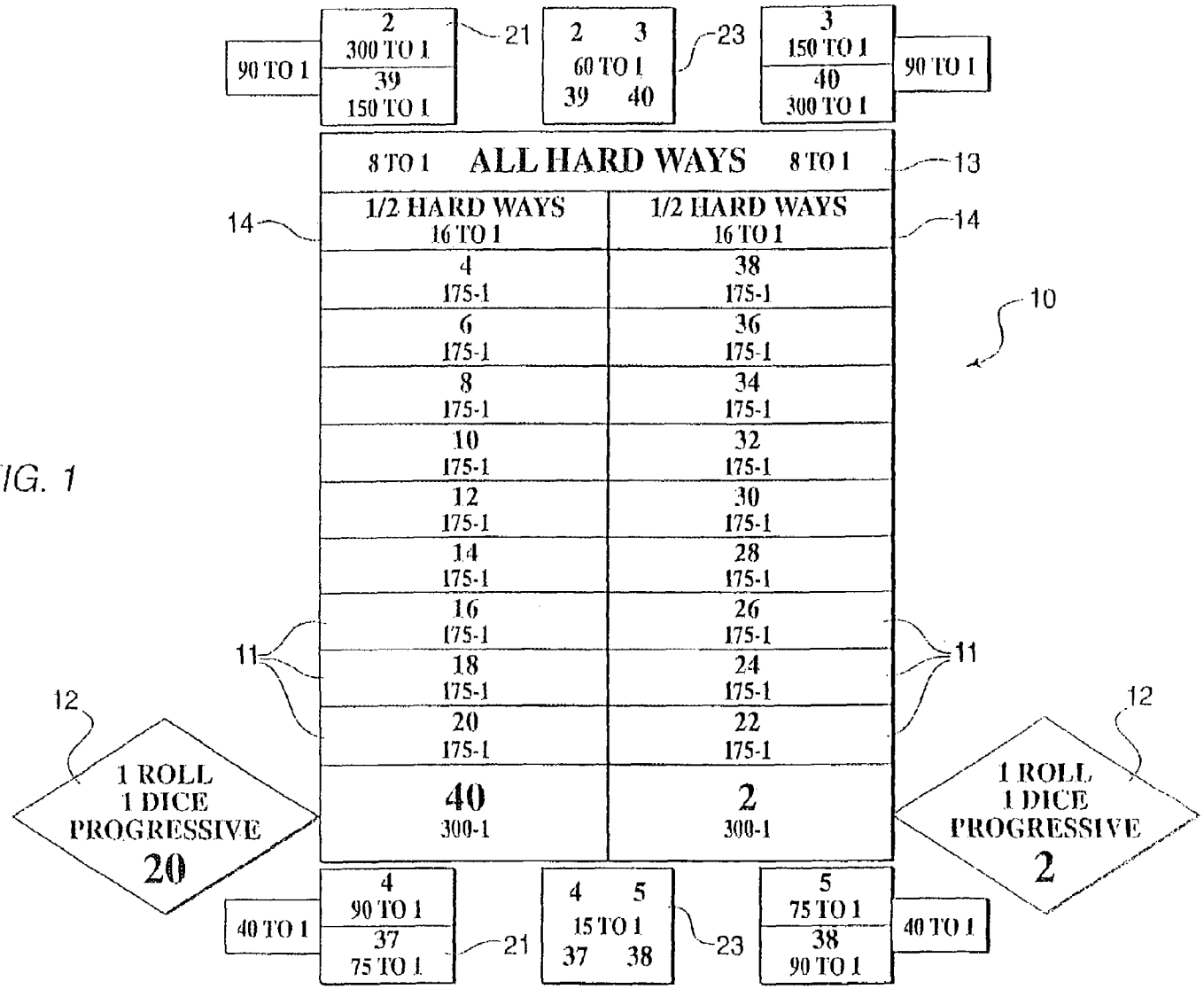
FIG. 1 shows a first embodiment of a primary playing area on the game surface.

Referring in detail to the drawing, FIG. 1 shows a primary playing area 10 of a game surface for a dice game preferably entitled "Throw Down." Primary playing area 10 comprises multiple wagering areas. The majority of primary playing area 10 consists of individual "hard way" wagering areas 11. Individual "hard way" wagering areas 11 are intended for wagers that the dice will result in two specific identical numbers. Each individual "hard way" wagering area is labeled with a single number. For example, a space labeled with the number "2" is intended for wagers that each die will produce a "1", with a double "1" resulting in a total of 2.Similarly, a space labeled with the number "10" is intended for wagers that each die will produce a "5."

Primary playing area 10 also has two progressive wagering areas 12. Each progressive wagering area 12 is associated with a single individual "hard way" wagering area 11. If a player wins on a wager placed on that individual "hard way" wagering area 11 that relates to progressive wagering area 12 and that player has also placed a wager on progressive wagering area 12, that player has a chance to win the progressive jackpot by rolling a single die. For example, in FIG. 1, progressive wagering area 12 relates to individual wagering areas 11 labeled with "2" and "40." A winning wager must be placed on individual wagering areas 11 labeled with "2" or "40" as well as the associated progressive wagering area 12 to have a chance to win the progressive jackpot.

Primary playing area 10 also includes an all "hard way" wagering area 13, for wagers that the dice will result in any set of doubles. Further, primary playing area 10 has two half "hard way" wagering areas 14. Individual "hard way" wagering areas 11 are arranged in two columns. Each half 14 is situated above a column. A wager placed on half "hard way" wagering area 14 wins if any of the doubles relating to individual "hard way" wagering areas 11 in that column wins.

Figure 2:
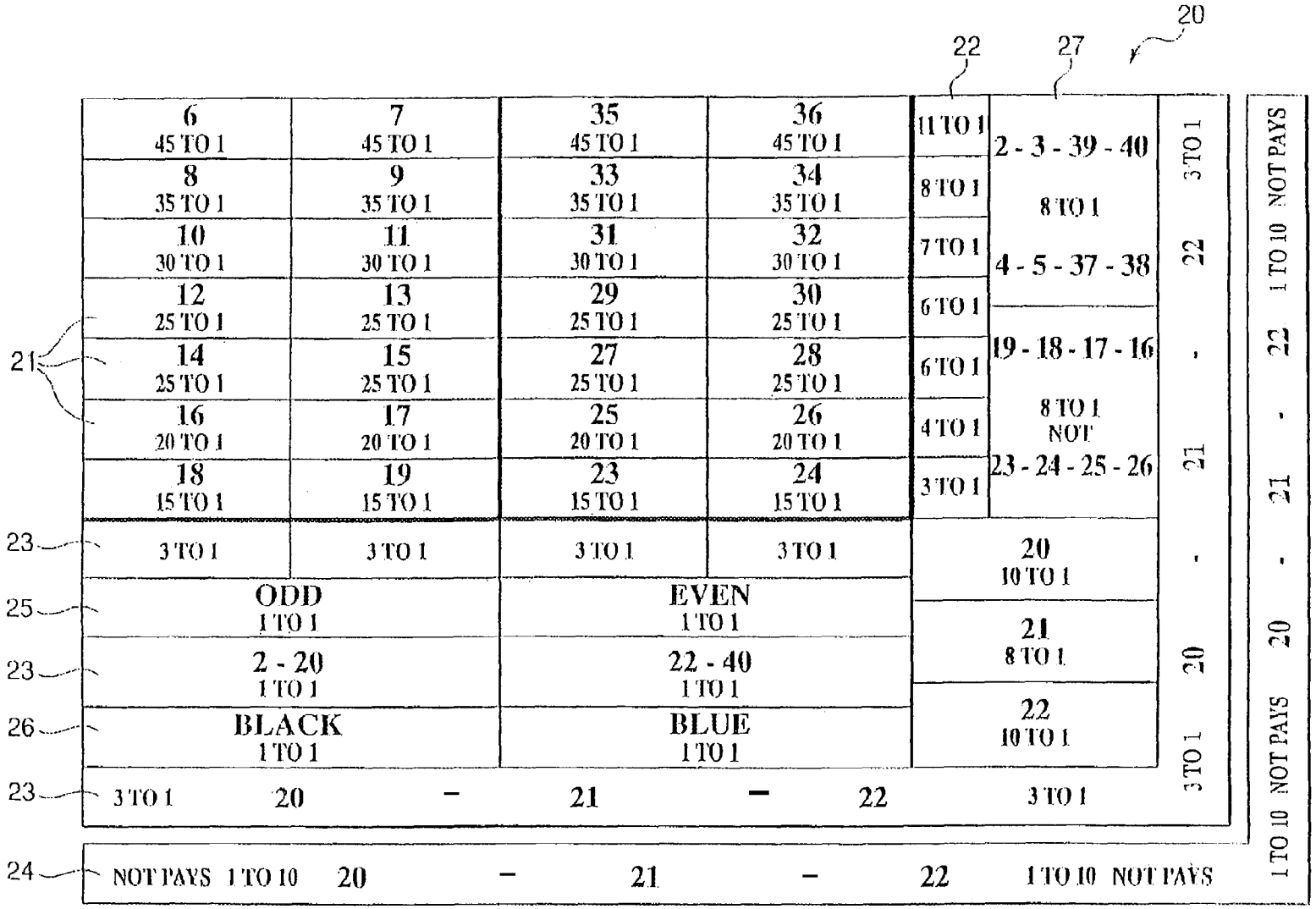
FIG. 2 shows a first embodiment of a secondary playing area on the game surface.

The playing surface also includes at least one secondary playing area 20 shown in FIG. 2. Secondary playing area 20 includes a plurality of individual number wagering areas 21. Individual number wagering areas 21 are each labeled with a single number. Wagers win if that number is rolled. Individual number wagering areas 21 are set up in a rectangular block so that players may also wager on rows of individual number wagering areas 22 and columns of individual number wagering areas 23. A wager on a row or column is a winning wager if an individual number in that row or column is rolled.

Secondary playing area 20 further includes a non-number wagering area 24 for wagers that specific numbers will not result. These wagers win if the numbers that are labeled on the areas are not rolled. Odd/even wagering areas 25 and color specific wagering areas 26 have winning wagers depending on whether the rolled number is odd or even and depending on what color the rolled number is. Finally, secondary playing area 20 has a multiple specific numbers wagering areas 27, where a wager wins if one of the multiple numbers, or a number within the range of numbers, indicated on the area is rolled.

The dice game is played using a pair of multi-sided dice, preferably 20-sided dice, on a game surface. A primary player is established to roll the dice. Each player places at least one wager on the game surface, and the dice are rolled onto the game surface. The wagers are resolved after each dice roll. Losing wagers are collected and winning wagers are paid according to payouts of the areas on the game surface.

If a player wagered on individual "hard way" wagering area 11 that relates to progressive wagering area 12, and wagered on progressive wagering area 12, and that individual "hard way" was rolled, the player is paid for the winning wager and has a chance to win the progressive pot. The player is given a single die to roll and if that player rolls a specified number with the single die the player wins the progressive pot associated with progressive wagering area 12. If the player fails to roll the designated number, the wager is placed in the progressive pot.

Players may wager on any of the wagering areas of the game surface. Each wagering area has a designated payout indicated on its area. After the winning wagers have been paid out, new wagers are placed on the game surface by the players. The dice are then passed to the next player who then rolls.

Figure 3:
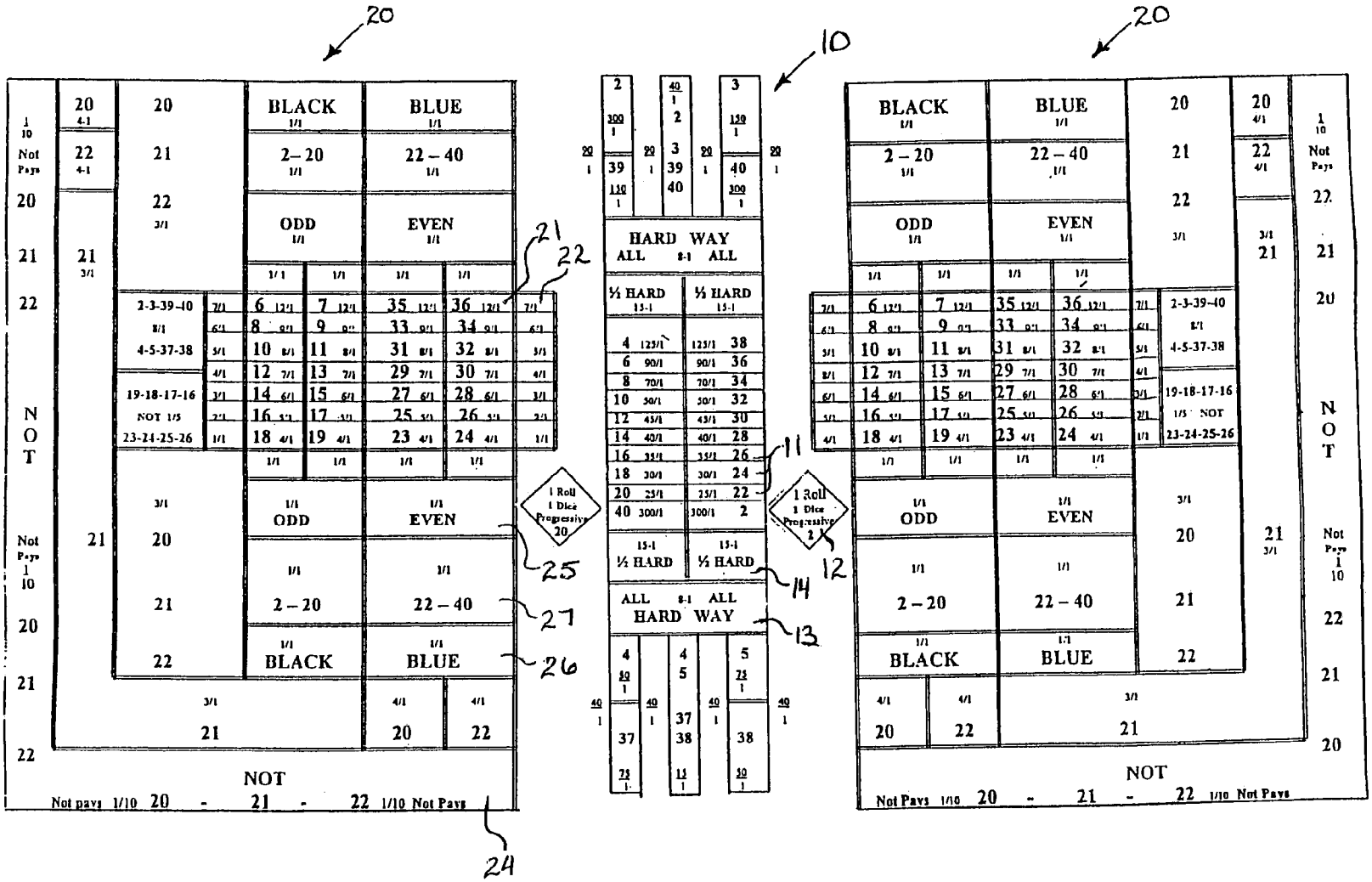
FIG. 3 shows a second embodiment of a game surface having a primary playing area and two secondary playing areas.

The game surface and the associated odds involved in playing the game with two twenty-sided dice is shown in FIGS. 1 and 2. An alternate game surface with alternate odds for twenty-sided dice is shown in FIG. 3. The surface and odds may be easily adapted for play with other dice including those with ten or twelve sides.

Figure 4:
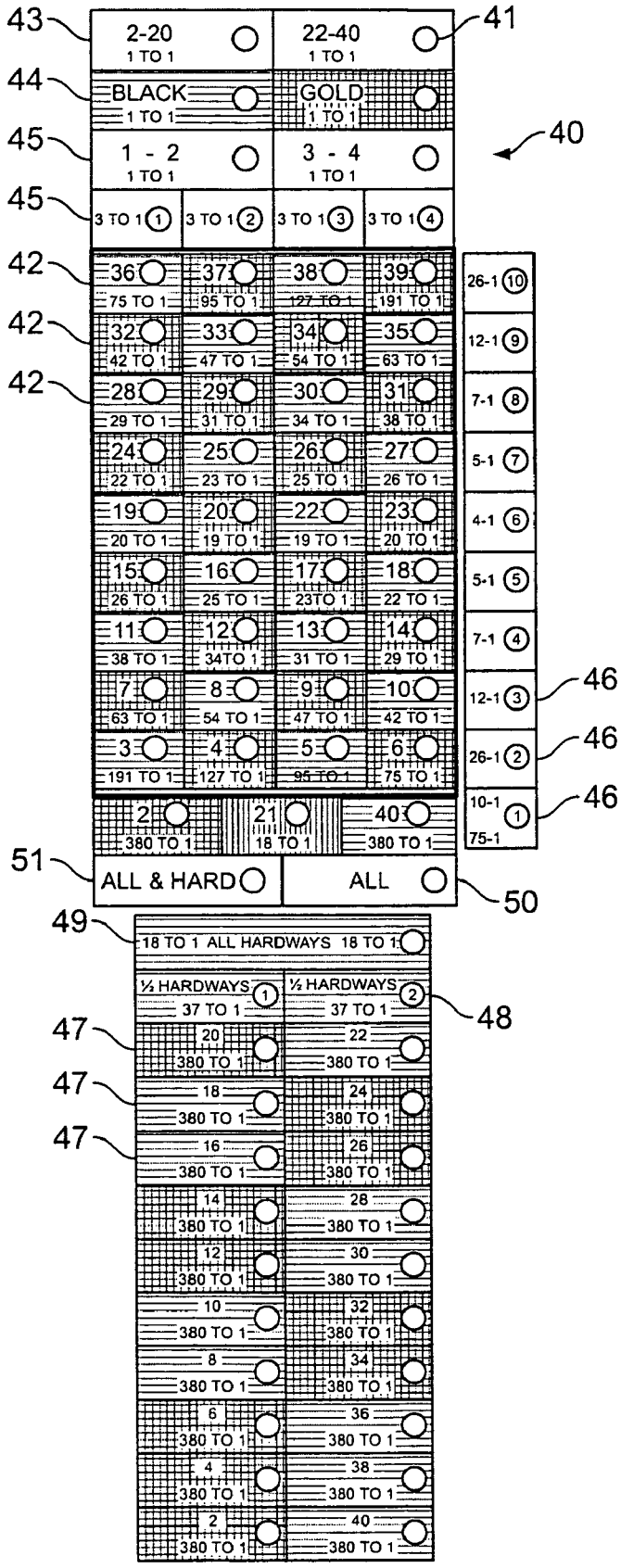
FIG. 4 shows another game surface which can be used to play a dice game according to another embodiment of the invention.
Figure 5:
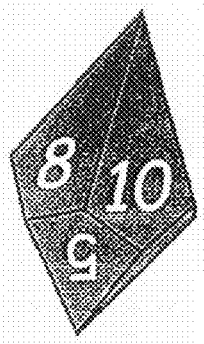
FIG. 5 is a front view of a 10-sided dice numbered from 1-10.
Figure 6:
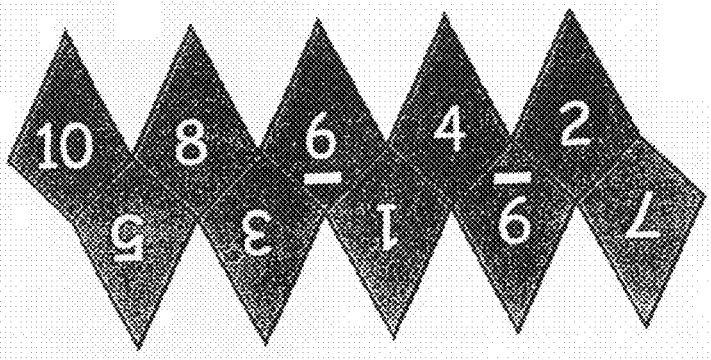
FIG. 6 is a planar representation of a 10-sided dice having sides numbered from 1-10.
Figure 7:
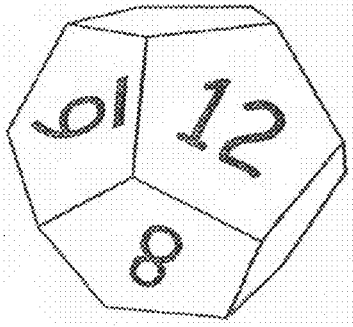
FIG. 7 is a front view of a 12-sided dice having sides numbered from 1-12.
Figure 8:
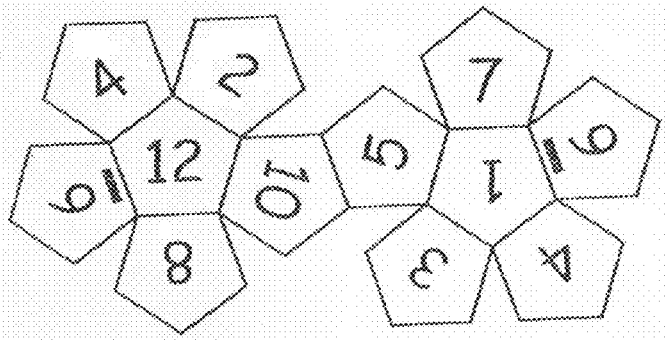
FIG. 8 is a planar representation of a 12-sided dice having sides numbered from 1-12.
Figure 9:
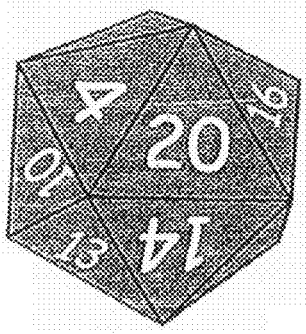
FIG. 9 is a front view of a 20-sided dice having sides numbered from 1-20.
Figure 10:
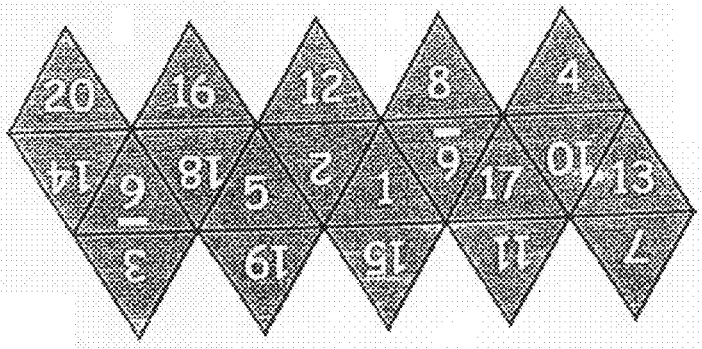
FIG. 10 is a planar representation of a 20-sides dice having sides numbered from 1-20.

FIG. 4 shows a game surface 40 which may be used to play a dice game according to another embodiment of the invention.

The game surface shown in FIG. 4 may be used to play a dice game with a pair of twenty-sided dice, each having sides numbered from 1 to 20, so that each roll of the pair of dice has a numeric outcome of from 2 to 40, in increments of one. A game surface according to the invention can also be adapted for play with a pair of multi-sided dice other than twenty-sided dice, for example a pair of ten or twelve-sided dice.

Players may stand or sit around a perimeter of the game surface. A player who is rolling or throwing the pair of dice may be positioned at either short end of the game surface (top or bottom areas as shown in FIG. 4) and the dice may be rolled or thrown in either direction. Game officials, for example a dealer, a "box man" and/or a "stick man" may be positioned at either long end of the game surface (the sides areas as shown in FIG. 4).

Players may indicate a wager or bet for a particular roll by placing one or more wagering devices in one or more wagering area corresponding to a predicted outcome of the roll. The wagering devices may comprise chips or markers, each having an associated value. A game official may employ a chip sorter, for example a "Chipper champ" sorter, to sort chips. Players may place wagering devices in a circular area 41 provided in each wagering area when the pair of dice are being thrown from one side of the game surface and outside of the circular area when the pair of dice are being thrown from the other side of the game surface.

As shown, the gaming surface has a plurality of wagering areas. A plurality of sum wagering areas 42 may be arranged in a plurality of rows and columns, as shown. Each of the plurality of sum wagering areas corresponds to a possible numeric outcome of a roll of the pair of dice. The corresponding numeric outcome may be displayed within the individual sum wagering area as shown. For example, game surface 40 may include thirty nine individual sum wagering areas numbered "2" through "40", in increments of one.

Each sum wagering area 42 has a payout ratio associated therewith. The payout ratio may be displayed within the associated sum wagering area 42 as shown. For example, the sum wagering area corresponding to a predicted roll outcome of 36 may have a payout ratio of 75 to 1 associated with it.

A player indicating a wager by placing a chip or marker in a particular sum wagering area 42 wins the wager if a numeric outcome of a subsequent roll of the dice corresponds to the predicted numeric outcome in the particular sum wagering area 42. In the event of a winning wager, the player is paid according to the payout ratio indicated in the sum wagering area 42. For example, if a player places a chip or marker having a value of $1 in sum wagering area 42 which corresponds to the outcome "36" and and a roll of the pair of dice yields an outcome of 36, the player placing the wager wins a sum of $75, corresponding to the payout ratio of 75 to 1 associated with that sum wagering area. The payout ratios shown are exemplary and the payout ratios associated with individual sum wagering area 42 and all other wagering areas may be set or adjusted by a casino or other authority.

Each of the plurality of sum wagering areas 42 has a color associated with it, for example gold, black or red. The color may be indicated by suitable indicia within the particular sum wagering area 42, for example by imprinting the color on the background or numerals or text in the sum wagering area 42. In the embodiment shown in FIG. 4, the sum wagering areas 42, which correspond to numeric outcomes 3, 5, 8, 10, 11, 13, 16, 18, 19, 22, 25, 27, 28, 30, 33, 35. 36, 38 and 40 are associated with the color black; the sum wagering areas 42 corresponding to numeric outcomes 2, 4, 6, 7, 9, 12, 14, 15, 17, 20, 23, 24, 26, 29, 31, 32, 34, 37 and 39 are associated with the color gold; and the sum wagering area 42 corresponding to the numeric outcome 21 is associated with the color red.

Game surface 40 further comprises a plurality of range wagering areas 43. Each range wagering area 43 corresponds to a range of numeric outcomes and has a payout ratio associated with it. The numeric outcome range and associated payout ratio may be indicated by any suitable means, for example, by imprinting the range and payout ratio within the range wagering area 43. Plurality of range wagering areas 43 may comprise, for example, two range wagering areas. As shown in FIG. 4, a first range wagering area may correspond to a numeric outcome of 2 through 20 and have a payout ratio of 1 to 1 and a second range wagering area may correspond to a numeric outcome of 22 through 40 and have a payout ratio of 1 to 1.

A player indicating a wager by placing a chip or marker in a particular range wagering area 43 wins the wager if a numeric outcome of a subsequent roll of the dice corresponds to the predicted range of numeric outcomes in the particular range wagering area 43. In the event of a winning wager, the player is paid according to the payout ratio indicated in the range wagering area 43. For example, if a player places a chip or marker having a value of $1 in a range wagering area 43 which corresponds to the range "22-40" and and a roll of the pair of dice yields an outcome of 36, the player placing the wager wins a sum of $1, corresponding to the payout ratio of 1 to 1 associated with that range wagering area. As with sum wagering areas 42, the payout ratios associated with range wagering areas 43 as shown are exemplary and these payout ratios may be set or adjusted by a casino or other authority.

Game surface 40 also includes a plurality of color wagering areas 44. Each of the plurality of color wagering areas 44 corresponds to a colors associated with a sum wagering area 42. Each of the color wagering areas 44 also has a payout ratio associated with it. The corresponding color and associated payout ratio may be indicated by any suitable means, for example, by imprinting the color, text indicating the color, and the payout ratio in the color wagering area.

A player indicating a wager by placing a chip or marker in a particular color wagering area 44 wins the wager if a numeric outcome of a subsequent roll of the dice corresponds to a numeric outcome in sum wagering area 42, which is associated with a predicted color in the particular color wagering area 44. In the event of a winning wager, the player is paid according to the payout ratio indicated in the color wagering area 44. For example, if a player places a chip or marker having a value of $1 in a color wagering area 44, which corresponds to the color black, and a roll of the pair of dice yields an outcome of 36, which corresponds to the color black, the player placing the wager wins a sum of $1, corresponding to the payout ratio of 1 to 1 associated with that color wagering area. As with other wagering areas, the payout ratios associated with color wagering areas 44 as shown are exemplary and these payout ratios may be set or adjusted by a casino or other authority.

Game surface 40 also has a plurality of column wagering areas 45. Each of the plurality of column wagering areas 45 corresponds one or more columns of sum wagering areas 42. Each of the plurality of column wagering areas 45 has a payout ratio associated with it. The columns and payout ratios associated with a particular column wagering area 45 may be indicated by a suitable means, for example by imprinting numeral or text indicating the corresponding column or columns and payout ratio on game surface 40.

As shown in FIG. 4, column wagering areas 45 may include a column wagering area corresponding to columns 1 and 2 and having a payout ratio of 1-1; a column wagering area corresponding to columns 3 and 4 and having a payout ratio of 1-1; a column wagering area corresponding to column 1 and having a payout ratio of 3-1; a column wagering area corresponding to column 2 and having a payout ratio of 3-1; a column wagering area corresponding to column 3 and having a payout ratio of 3-1; and a column wagering area corresponding to column 4 and having a payout ratio of 3-1.

A player indicating a wager by placing a chip or marker in a particular column wagering area 45 wins the wager if a numeric outcome of a subsequent roll of the dice corresponds to a numeric outcome in sum wagering area 42, which is situated in a column corresponding to particular column wagering area 44. In the event of a winning wager, the player is paid according to the payout ratio indicated in the column wagering area 45. For example, if a player places a chip or marker having a value of $1 in a column wagering area 45, which corresponds to column 1, and a roll of the pair of dice yields an outcome of 36, which is situated in column 1, the player placing the wager wins a sum of $1, corresponding to the payout ratio of 1 to 1 associated with that column wagering area. As with other wagering areas, the payout ratios associated with column wagering areas 45 as shown are exemplary and these payout ratios may be set or adjusted by a casino or other authority.

Game surface 40 also has a plurality of row wagering areas 46. Each of the plurality of row wagering areas 46 corresponds to one or more rows of sum wagering areas 42. Each of the plurality of row wagering areas 42 also has a payout ratio associated with it. The rows and payout ratios associated with a particular row wagering area 46 may be indicated by a suitable means, for example by imprinting numerals or text indicating the corresponding row or rows and payout ratio on game surface 40.

As shown in FIG. 4, row wagering areas 46 may include row wagering areas corresponding to each of rows 1 through 10. A row wagering area 46 may have multiple payout ratios associated with it. For example, as shown in FIG. 4, a row wagering area 46 corresponding to row 1, which includes numeric outcomes "2", "21" and "40" may have a payout ratio of 10 to 1 associated with the numeric outcome "21" and a payout ratio of 75-1 associated with the outcomes "2" and "40".

A player indicating a wager by placing a chip or marker in a particular row wagering area 46 wins the wager if a numeric outcome of a subsequent roll of the dice corresponds to a numeric outcome in sum wagering area 42, which is situated in a row corresponding to particular row wagering area 46. In the event of a winning wager, the player is paid according to the payout ratio indicated in the row wagering area 46. For example, if a player places a chip or marker having a value of $1 in a row wagering area 46, which corresponds to row 10, and a roll of the pair of dice yields an outcome of 36, which is situated in row 10, the player placing the wager wins a sum of $26, corresponding to the payout ratio of 26 to 1 associated with that row wagering area. As with other wagering areas, the payout ratios associated with row wagering areas 46 as shown are exemplary and these payout ratios may be set or adjusted by a casino or other authority.

Game surface 40 also has a plurality of doubles (or "hard way") wagering areas 47. Each of the plurality of doubles wagering areas 47 corresponds to a possible numeric outcome of the roll of the pair of dice comprising two identical numerals. Each of the plurality of doubles wagering areas 47 also has an associated color and an associated payout ratio. The numeric outcome, colors, and payout ratios associated with a particular doubles wagering areas 47 may be indicated by a suitable means, for example by imprinting the color, numerals or text indicating the corresponding color and payout ratio on game surface 40. The color associated with an individual doubles wagering area 47 is the same as the color associated with a sum wagering area 42 for any given numeric result.

As shown in FIG. 4, doubles wagering areas 47 may be arranged in two parallel columns, wherein a first column corresponds to numeric results 2, 4, 6, 8, 10, 12, 14, 16, 18 and 20 and a second column corresponds to numeric results 22, 24, 26, 28, 30, 32, 34, 36, 38 and 40.

A player indicating a wager by placing a chip or marker in a particular doubles wagering area 47 wins the wager if a numeric outcome of a subsequent roll of the dice corresponds to a predicted numeric outcome in doubles wagering area 47 and comprises two identical numerals. In the event of a winning wager, the player is paid according to the payout ratio indicated in the doubles wagering area 47. For example, if a player places a chip or marker having a value of $1 in a doubles wagering area 47 which corresponds to 36 the "hard way", and a roll of the pair of dice results in each die having an outcome of 18 for a total of 36 (a roll of "36 the hard way"), the player placing the wager wins a sum of $380, corresponding to the payout ratio of 380 to 1 associated with that doubles wagering area. As with other wagering areas, the payout ratios associated with doubles wagering areas 47 as shown are exemplary and these payout ratios may be set or adjusted by a casino or other authority.

Game surface 40 also has a plurality of doubles range wagering areas 48. Each of the doubles range wagering areas 48 correspond to a range of possible numeric outcomes of the roll of the pair of dice comprising two identical numerals. Each of the plurality of doubles range wagering areas 48 also has a payout ratio associated with it. The doubles ranges and payout ratios associated with a particular doubles range wagering areas 48 may be indicated by a suitable means, for example, by imprinting the range and payout ratio on game surface 40.

As shown in FIG. 4, doubles range wagering areas 48 may comprise two doubles range wagering areas, wherein a first doubles range wagering area corresponds to a first column of doubles wagering areas and a second doubles range wagering area corresponds to a second column of doubles wagering areas.

A player indicating a wager by placing a chip or marker in a particular doubles range wagering area 48 wins the wager if a numeric outcome of a subsequent roll of the dice corresponds to a predicted numeric outcome in doubles wagering area 47, which is within the range corresponding to the doubles range wagering area and comprises two identical numerals. In the event of a winning wager, the player is paid according to the payout ratio indicated in the doubles range wagering area 48. For example, if a player places a chip or marker having a value of $1 in a doubles wagering range area 48, which corresponds to the second column of 1/2 hard ways as shown in FIG. 4 (right hand column), and a roll of the pair of dice results in each die having an outcome of 18 for a total of 36 (a roll of "36 the hard way"), the player placing the wager wins a sum of $37, corresponding to the payout ratio of 37 to 1 associated with that doubles range wagering area. As with other wagering areas, the payout ratios associated with doubles range wagering areas 48 as shown are exemplary and these payout ratios may be set or adjusted by a casino or other authority.

Game surface 40 has an all doubles wagering area 49 which corresponds to all possible numeric outcomes of the roll of the pair of dice corresponding to two identical numerals. All doubles wagering area 49 has a payout ratio associated with it. The all doubles wagering area 49 and payout ratio may be indicated by a suitable means, for example by imprinting appropriate text and/or numerals on game surface 40.

A player indicating a wager by placing a chip or marker in all doubles wagering area 49 wins the wager if a numeric outcome of a subsequent roll of the dice comprises two identical numerals. In the event of a winning wager, the player is paid according to the payout ratio indicated in the all doubles wagering area 49. For example, if a player places a chip or marker having a value of $1 in all doubles wagering area 49, and a roll of the pair of dice results in each die having an outcome of 18 for a total of 36 (a roll of "36 the hard way"), the player placing the wager wins a sum of $18, corresponding to the payout ratio of 18 to 1 associated with all doubles wagering area 49. As with other wagering areas, the payout ratios associated with all doubles wagering areas 49 as shown are exemplary and these payout ratios may be set or adjusted by a casino or other authority.

Game surface 40 further includes an all sums wagering area 50 corresponding to all of the plurality of sum wagering areas 42.

Indicating a wager by placing a chip or marker in all sums wagering area 50 is the equivalent of making multiple individual wagers on each and every sum wagering area 42. Accordingly, a wager placed in all sums wagering area 50 will result in one winning result for every roll of the pair of dice because all possible numeric outcomes are bet on.

As shown in FIG. 4, a wager placed in all sums wagering area 50 is the same as placing thirty nine individual wagers in each of the sum wagering areas 42, corresponding to numeric outcomes 2 through 40.

For example, a player could make a $1 wager on each of sum wagering areas 42 by placing chips having a value of $39 within all sum wagering area 50. If a subsequent roll of the pair of dice yielded a result of 36, the player would win the $1 wager placed on 36 and would win $75 based on the payout ratio of 75 to 1 associated with the sum wagering area corresponding to numeric result 36. The player would also lose each of the remaining thirty eight $1 wager and accordingly forfeit an amount of $38.

Game surface 40 further includes an all sums all doubles wagering area 51 corresponding to all of the plurality of sum wagering areas 42 and all of the plurality of double wagering areas.

Indicating a wager by placing a chip or marker in all sums all doubles wagering area 51 is the equivalent of making multiple individual wagers on each and every sum wagering area 42 and doubles wagering area 47. Accordingly, a wager placed in all sums all doubles wagering area 51 will result in one or two winning results for every roll of the pair of dice because all possible numeric outcomes are bet on.

As shown in FIG. 4, a wager placed in all sums all doubles wagering area 51 is the same as placing fifty nine individual wagers in each of the sum wagering areas 42 and doubles wagering areas 47. For example, a player could make a $1 wager on each of sum wagering areas 42 and doubles wagering areas 47 by placing chips having a value of $59 within all sums all doubles wagering area 51. If a subsequent roll of the pair of dice yielded a result of 36, and comprised two individual results of 18 (a roll of "36 the hard way"), the player would win the $1 wager placed on 36 in sums wagering area 42 and would win $75 based on the payout ratio of 75 to 1 associated with the sum wagering area corresponding to numeric result 36. Additionally, the player would win the $1 wager placed on 36 in doubles wagering area 47 and would win $380 based on the payout ratio of 380 to 1 associated with the doubles wagering area 47. The player would also lose each of the remaining fifty seven $1 wagers and, accordingly, forfeit an amount of $57.

If, however, the roll of dice yielded a numeric result of 36, but did not comprise two 18's (for example if one die indicated 21 and another die indicated 15), the player placing a wager in all sums all doubles wagering area 52 would win the wager based on the sum wagering area corresponding to the numeric result 36, but would not win any of the doubles wagers because the roll did not result in two identical numbers.

Accordingly, while a number of embodiments of the present invention has been shown and described, it is obvious that many changes and modifications may be made thereunto without departing from the spirit and scope of the invention.

What is claimed is:

1. A game surface for a dice game consisting of a pair of multi-sided dice, selected from the group consisting of a pair of 10 sided dice, a pair of 12 sided dice and a pair of 20 sided dice, the game surface comprising a) a plurality of sum wagering areas arranged in a plurality of rows and a plurality of columns, wherein each of said plurality of sum wagering areas corresponds to a possible numeric outcome of a roll of the pair of multi-sided dice, each of said plurality of sum wagering areas has an associated color, and each of said plurality of sum wagering areas has an associated payout ratio;

b) a plurality of range wagering areas, wherein each of said plurality of range wagering areas corresponds to a range of numeric outcomes of the roll of the pair of multi-sided dice and each of said plurality of range wagering areas has an associated payout ratio;

c) a plurality of color wagering areas, wherein each of said plurality of color wagering areas corresponds to said color associated with at least one of said plurality of sum wagering areas and each of said color wagering areas has an associated payout ratio;

d) a plurality of column wagering areas, wherein each of said plurality of column wagering areas corresponds to at least one of said plurality of columns of said sum wagering areas and each of said plurality of column wagering areas has an associated payout ratio;

e) a plurality of row wagering areas, wherein each of said plurality of row wagering areas corresponds to at least one of said plurality of rows of said sum wagering areas and each of said plurality of row wagering areas has an associated payout ratio;

f) a plurality of doubles wagering areas, wherein each of said plurality of doubles wagering areas corresponds to a possible numeric outcome of the roll of the pair of multi-sided dice comprising two identical numerals commencing from the sum of 2, each of said plurality of doubles wagering areas has an associated color, and each of said plurality of doubles wagering areas has an associated payout ratio;

g) a plurality of doubles range wagering areas, wherein each of said doubles range wagering areas corresponds to a range of possible numeric outcomes of the roll of the pair of multi-sided dice comprising two identical numerals, and each of said plurality of doubles range wagering areas has an associated payout ratio;

h) an all doubles wagering area corresponding to all possible numeric outcomes of the roll of the pair of multi-sided dice comprising two identical numerals, commencing from the sum of 2 wherein said all doubles wagering area has an associated payout ratio;

i) an all sums wagering area corresponding to all of said plurality of sum wagering areas; and an all sums all doubles wagering area corresponding to all of said plurality of sum wagering areas, said game surface indicating the possible numeric outcome of a roll of the pair of multi-sided dice commencing with the sum of two, wherein said game surface and odds written thereon being adopted for play with said multi-sided dice.

2. The game surface according to claim 1, wherein at least one of said plurality of row wagering areas has a plurality of payout ratios and each of said plurality of payout ratios is associated with one or more of said sum wagering areas in a given row.

3. The game surface according to claim 1, wherein said plurality of doubles wagering areas comprises two doubles wagering areas arranged in two parallel columns.

4. The game surface according to claim 3, wherein said plurality of doubles range wagering areas comprises two doubles range wagering areas, wherein a first doubles range wagering area corresponds to a first column of double wagering areas and a second doubles range watering area corresponds to a record.

5. The game surface according to claim 1 wherein a pair of 20-sided dice is used and the sum of roll of the pair of dice has a possible numeric outcome ranging from 2 to 40.

* * * * *